United States Patent [19]

Abe et al.

[11] 4,162,930

[45] Jul. 31, 1979

[54] AUSTENITIC STAINLESS STEEL HAVING EXCELLENT RESISTANCE TO INTERGRANULAR AND TRANSGRANULAR STRESS CORROSION CRACKING

[75] Inventors: Seizaburo Abe; Masao Kozima, both of Yokohama; Yuzo Hosoi, Tokyo, all of Japan

[73] Assignee: Nippon Steel Corporation, Japan

[21] Appl. No.: 782,788

[22] Filed: Mar. 30, 1977

[30] Foreign Application Priority Data

Mar. 30, 1976 [JP] Japan ..... 51/34188

[51] Int. Cl.[2] ..... C22C 38/48

[52] U.S. Cl. ..... 148/38; 75/128 R; 75/128 A; 75/128 C; 75/128 N; 75/128 G

[58] Field of Search ..... 75/128 A, 128 C, 128 G, 75/128 R, 128 T, 128 N; 148/38

[56] References Cited

U.S. PATENT DOCUMENTS

| | | | |
|---|---|---|---|
| 3,303,023 | 2/1977 | Dulis et al. | 75/128 N |
| 3,486,885 | 10/1969 | Armijo | 75/128 R |
| 3,523,788 | 8/1970 | Bates et al. | 75/128 C |
| 3,563,728 | 2/1971 | Allio et al. | 75/128 N |
| 3,785,787 | 1/1974 | Yokota et al. | 75/128 C |
| 3,795,509 | 3/1974 | Mimino et al. | 75/128 T |
| 3,910,788 | 10/1975 | Fujioka et al. | 75/128 C |
| 4,002,510 | 1/1977 | Wilde | 75/128 C |

FOREIGN PATENT DOCUMENTS

| | | | |
|---|---|---|---|
| 1183674 | 3/1970 | United Kingdom | 75/128 G |

*Primary Examiner*—Arthur J. Steiner

*Attorney, Agent, or Firm*—Wenderoth, Lind & Ponack

[57] ABSTRACT

There is provided a chromium-nickel austenitic stainless steel having improved resistance to intergranular stress corrosion cracking. The steel has low carbon and phosphorus content or carbon and phosphorus in solid solution fixed by niobium addition. Further resistance to transgranular stress corrosion cracking is realized with a low molybdenum content. The steel is particularly useful in applications involving exposure to high-temperature and high-pressure water and attack by chlorides.

2 Claims, 7 Drawing Figures

AUSTENITIC STAINLESS STEEL HAVING EXCELLENT RESISTANCE TO INTERGRANULAR AND TRANSGRANULAR STRESS CORROSION CRACKING

BACKGROUND OF THE INVENTION

The present invention relates to an austenitic stainless steel.

Austenitic stainless steels have been widely used in various fields for their excellent corrosion resistance, but they have a defect in that they have relatively high susceptibility to stress corrosion cracking.

Stress corrosion cracking includes intergranular stress corrosion cracking which is very often seen in applications where the steels are exposed to high-temperature and high-pressure water, such as piping in a nuclear reactor. Stress corrosion cracking also includes transgranular stress corrosion cracking which is very often seen when the steels are exposed to chloride media such as sea-water heat exchangers.

The intergranular stress corrosion cracking is considered to be caused by a chromium impoverished layer due to intergranular precipitation of chromium carbide. B. F. Wilde and J. E. Weber studied the effects of carbon content on the stress corrosion cracking time of a sensitized 18Cr-9Ni stainless steel in a high-temperature and high-pressure water (289° C.) containing 100 ppm oxygen, and reported that with carbon contents of less than 0.02% no stress corrosion cracking is seen as shown in FIG. 1 and a welded 304-L stainless steel can be safely used in the media (Brit. Corr. J. 4, 42, 1969).

Also it is said that transgranular stress corrosion cracking is promoted by impurities such as P, Mo and N. It has been disclosed in U.S. Pat. No. 3,486,885 that the intergranular corrosion resistance of a high-purity austenitic stainless steel with lowered phosphorus and sulfur contents is satisfactory when its carbon content is lowered to 0.02%.

However, effects of impurities on the resistance to the intergranular stress corrosion cracking have not been clarified, and an austenitic stainless steel having excellent resistance both to the intergranular and transgranular stress corrosion crackings has not been developed.

Conventional Type 304 and Type 316 stainless steels and Type 321 stainless steel stabilized by titanium and Type 347 stainless steel stabilized by niobium can not be used safely in high-temperature and high-pressure water and chloride environments.

SUMMARY OF THE INVENTION

One of the objects of the present invention is to provide an austenitic stainless steel having excellent resistance to the intergranular stress corrosion cracking as well as to the transgranular stress corrosion cracking.

The austenitic stainless steel according to the present invention is based on a principle that the solid soluted carbon content is lowered to 0.004% or less and the free phosphorous content is lowered to 0.005% or less, and when niobium is added in an amount 15 to 20 times the carbon content, the total carbon content is allowed to be not more than 0.02% and the total phosphorus content is allowed to be not more than 0.013%, and the molybdenum content is limited to 0.05% or less.

The stainless steel in which the carbon and phosphorus contents are lowered or niobium is added to fix the carbon and phosphorus in solid solution, shows excellent resistance to the intergranular stress corrosion cracking as solution-heat-treated and even when welded, and stands up well in high-temperature and high-pressure water environments, and is suitable for use in severe applications such as nuclear reactor piping. Further, with the restriction of the molybdenum content, the steel shows excellent resistance to the transgranular as well as the intergranular stress corrosion cracking, and stands up well in chloride environments. It is thus very useful for applications such as sea-water heat exchangers.

BRIEF DESCRIPTION OF THE DRAWINGS

FIG. 2 shows effects of the carbon content and the heat-treatment on the intergranular stress corrosion cracking of an austenitic stainless steel in a high-temperature and high-pressure water.

FIG. 3 shows effects of the phosphorus content and the heat-treatment on the same.

FIG. 4 shows effects of the carbon, titanium and niobium contents on the same.

FIG. 5 shows effects of the ratio of Nb/C on the same.

FIG. 6 shows effects of the total carbon content and the heat-treatment on the intergranular stress corrosion cracking of a Nb-stabilized stainless steel.

FIG. 7 shows effects of the phosphorus, molybdenum and nitrogen contents on the transgranular stress corrosion cracking of an austenitic stainless steel in a chloride environment.

DETAILED DESCRIPTION OF THE INVENTION

The present invention has been completed on the basis of studies and investigations on the stress corrosion cracking resistance of an austenitic stainless steel in a high-temperature and high-pressure water and chloride environments.

It has been found by the present inventors that it is necessary to maintain the solid soluted carbon content in an amount not more than 0.004% in order to eliminate the susceptibility of a Cr-Ni austenitic stainless steel to the intergranular stress corrosion cracking.

Figure 1:
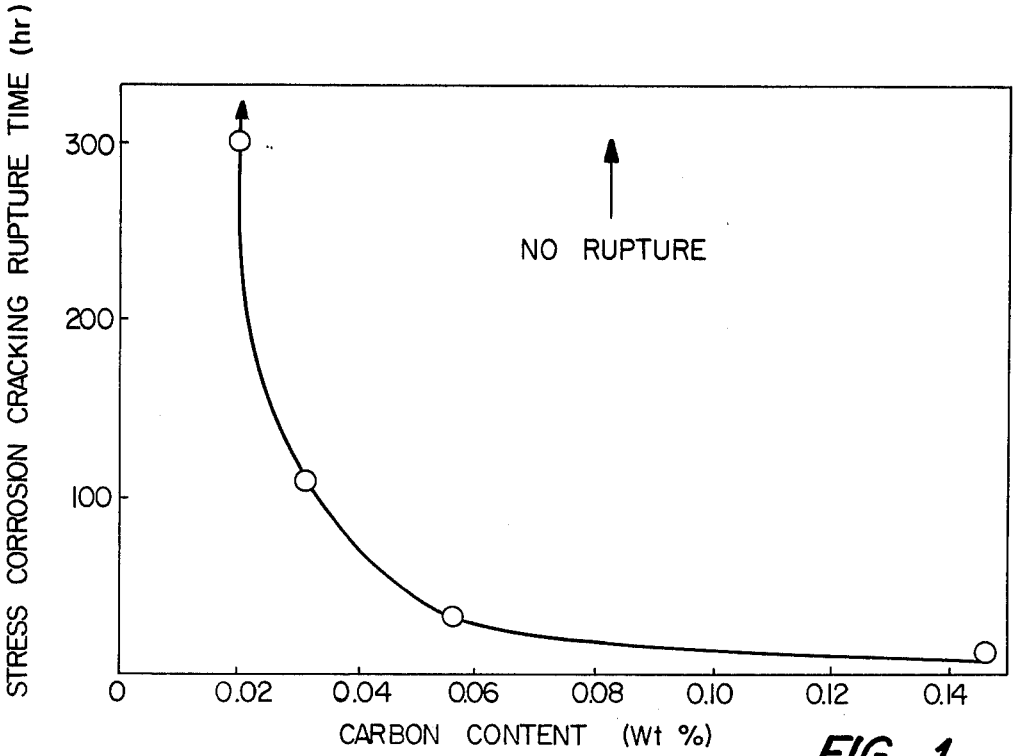
FIG. 1 shows effects of the carbon contents on the intergranular stress corrosion crackings of an austenitic stainless steel in a high-temperature and high-pressure water as reported by Wilde et al.
Figure 2:
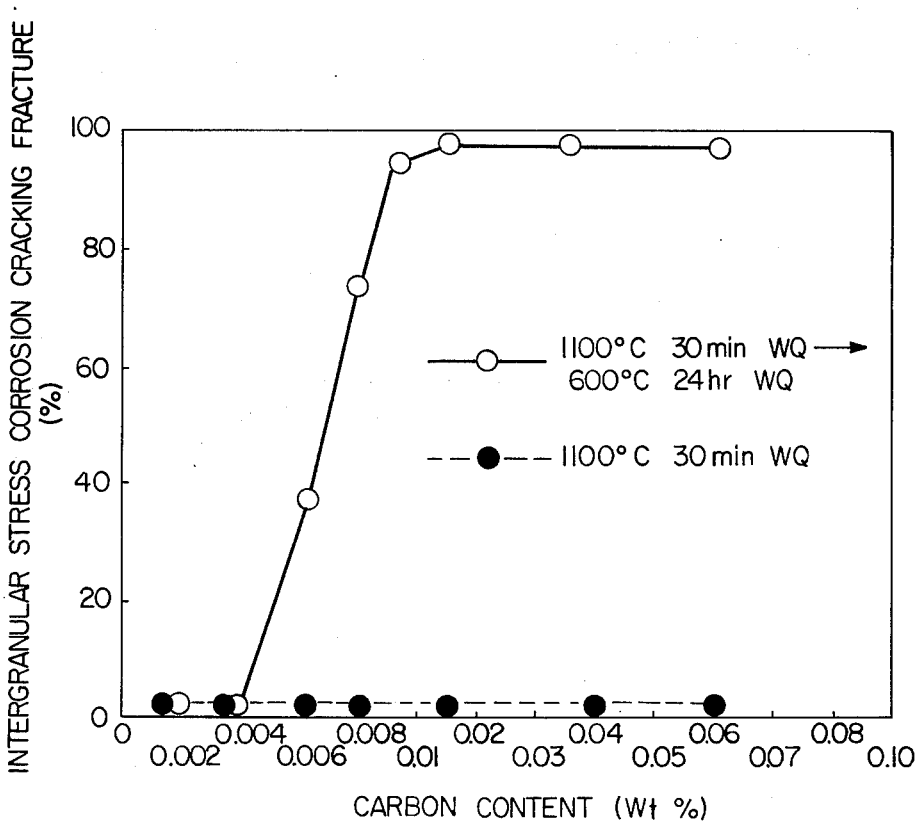
FIGS. 2 to 7 show results of experiments conducted by the present inventors.

FIG. 2 shows effects of the carbon content on the intergranular stress corrosion cracking susceptibility, in high-temperature and high-pressure water, of a high-purity grade of Cr: 18.5% , Ni: 11.3%, Mn: 1.2%, Si:0.6%, P: 0.003%, S: 0.003%, N: 0.005%, Oxygen: 0.003% which was subjected to solution heat-treatment at 1100° C. for 30 minutes, water quenched, and sensitized at 600° C. for 24 hours. It is clearly shown that the solid solution carbon content of 0.02% or less, which has been regarded as satisfactory, is not a safeguard for completely eliminating the intergranular stress corrosion cracking susceptibility of the sensitized austenitic stainless steel, and even with lowered solid solution carbon contents ranging from 0.006 to 0.01%, there is still danger of intergranular stress corrosion cracking. On the other hand, the solution heat-treated material does not show the cracking with solid solution carbon contents not more than 0.06%.

It has been further discovered by the present inventors that it is necessary to lower the solid solution carbon content to an amount not more than 0.004% and at the same time to lower the impurity phosphorus content in solid solution to an amount not higher than 0.005% in order to eliminate the intergranular stress corrosion cracking susceptibility of a Cr-Ni austenitic stainless steel.

Figure 3:
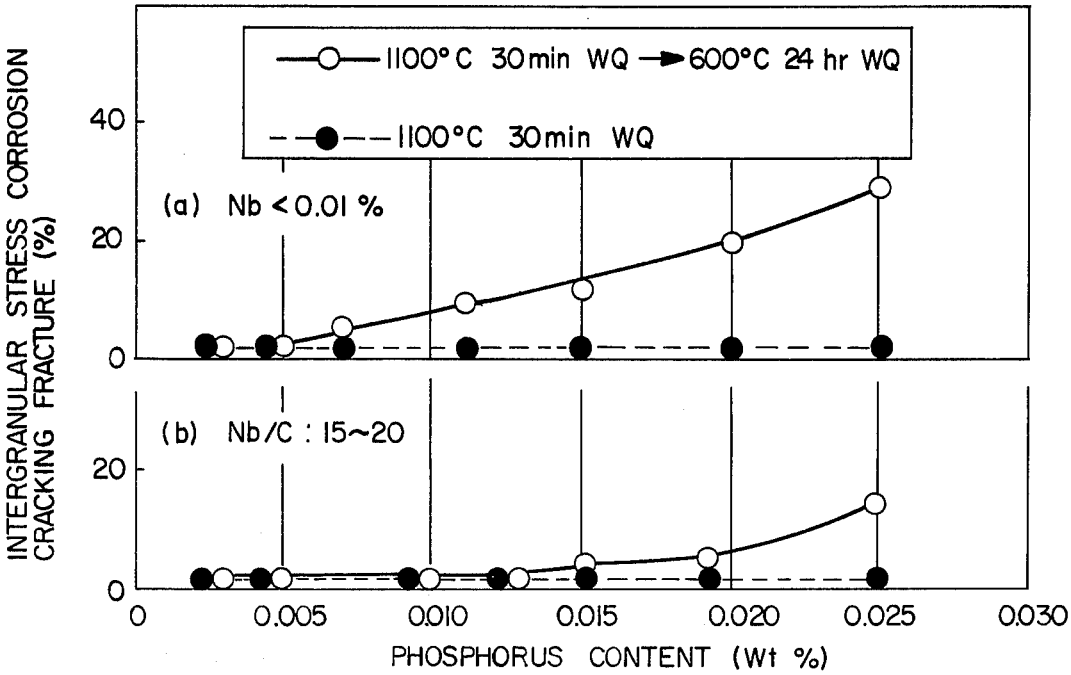

FIG. 3 shows the effects of the phosphorus content on the intergranular stress corrosion cracking susceptibility of a stainless steel of C: 0.002%, Cr: 18.5%, Ni: 11.3%, Mn: 1.2%, Si: 0.6%, S: 0.003%, N: 0.005%, Oxygen: 0.003% which was subjected to a solution heat-treatment at 1100° C. for 30 minutes, water quenched, and sensitized at 600° C. for 24 hours. It is clearly understood that since phosphorus increases the susceptibility to the intergranular stress corrosion cracking, it is necessary to lower the impurity phosphorus content in solid solution, as well as the carbon content, to an amount not more than 0.005%, in order to prevent the intergranular stress corrosion cracking of the sensitized steel material. Thus phosphorus, like carbon, does not produce adverse effects on the intergranular stress corrosion cracking resistance when the steel is in a solution heat-treated state, but increases the susceptibility to the intergranular stress corrosion cracking when the steel is in a sensitized state.

As described above, the susceptibility of a sensitized austenitic stainless steel to the intergranular stress corrosion cracking in a high-temperature and high-pressure water environment is increased either by carbon and phosphorus, and therefore in order to improve the intergranular stress corrosion resistance, it is necessary to restrict the phosphorus content as well as the carbon content.

It has been further discovered by the present inventors that when niobium is added for stabilization of the carbon content, carbon may be present up to 0.02%, and phosphorus may be present up to 0.013%, preferably up to 0.008%.

Type 321 and Type 347 stainless steels, in which the solid soluted carbon is fixed by titanium or niobium as to TiC or NbC to improve the intergranular corrosion resistance, have been long known and widely used.

Figure 4:
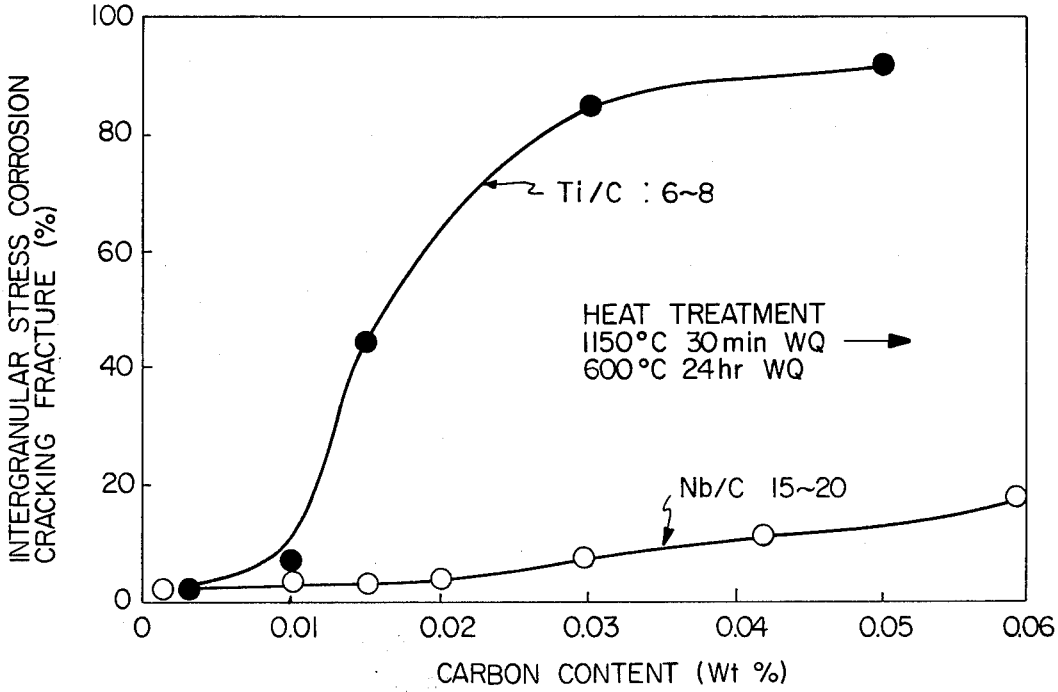
Figure 5:
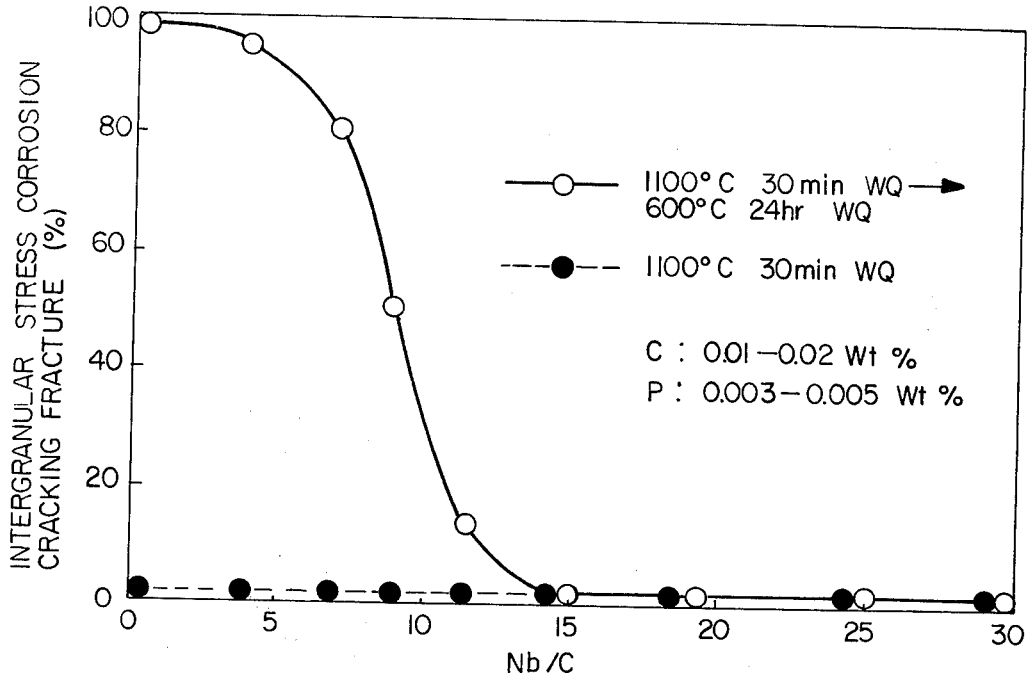
Figure 6:
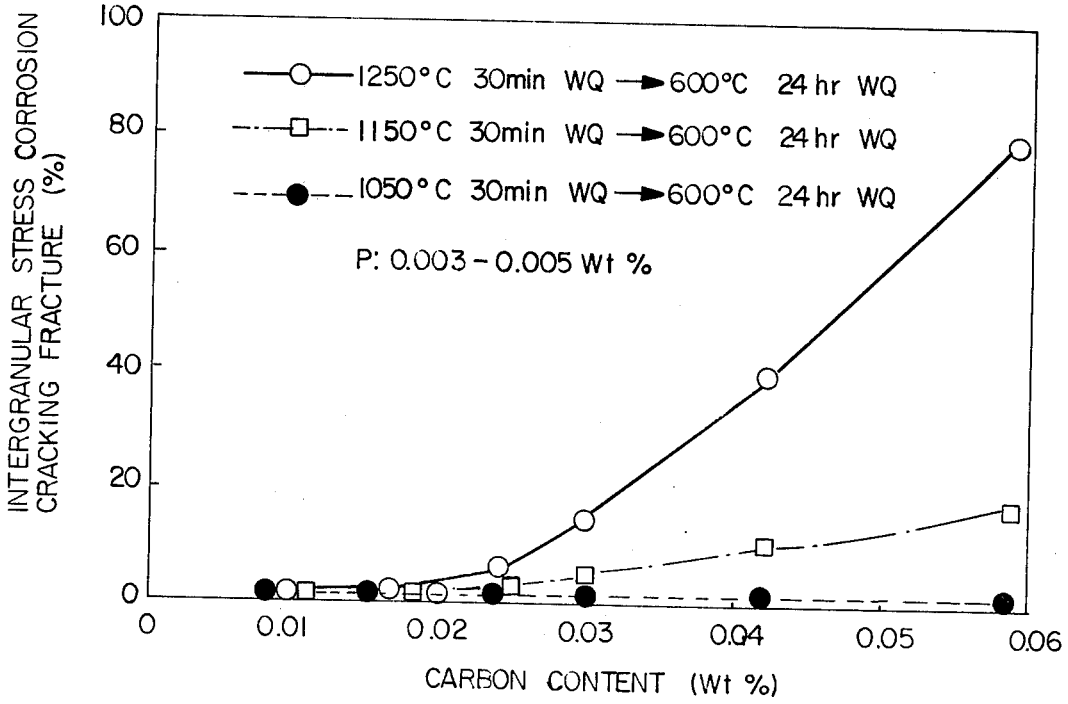

However, titanium is inferior to niobium in its effect of preventing the intergranular stress corrosion cracking of a sensitized steel in a high-temperature and high-pressure water environment as shown in FIG. 4. The stabilization effect of niobium on the carbon content can be obtained when the ratio of Nb/C is not lower than 15 as shown in FIG. 5. In case of Nb-stabilization, when the steel containing a total carbon content not lower than 0.02% is subjected to a solution heat-treatment at 1150° C. or higher, intergranular stress corrosion cracking appears during some subsequent sensitization heat treatments. This is considered due to an increased solid solution carbon content caused by decomposition of NbC at high temperatures of 1150° C. or higher. Therefore, on the basis of the results shown in FIG. 2, it is necessary to restrict the total carbon content to an amount not more than 0.02%, even in case of the niobium addition, in order to limit the solid solution carbon content to an amount not more than 0.004%, which can precipatate as chromium carbide in the grain boundaries during the sensitization heat-treatment after the solution heat-treatment.

Further as shown in FIG. 3 (*b*) in case where the carbon content is stabilized by niobium as NbC, the total phosphorus content may be up to 0.013%, because phosphorus precipitates in the grains as (NbP)C or Nb(PC) together with NbC, so that the solid solution phosphorus content is decreased.

As clearly understood from the results of chemical analysis of electrolytic extraction residues of Nb-containing steels, the phosphorus content in the residues shows a 40 to 50 fold increase as compared with the phosporus content in the steels. Therefore, in a Nb-stabilized steel, the phosphorus content as impurity may be about 2 times larger than that allowable in a non-stabilized steel as shown in FIG. 3 (*a*).

Table 1

| Sample No. | Average P content in Steel | P content in Electrolytic Extraction Residues (wt.%) |
|---|---|---|
| 1 | 0.013 | 0.67 |
| 2 | 0.020 | 0.86 |
| 3 | 0.025 | 1.13 |

On the other hand, when the total carbon content is restricted to an amount not more than 0.02%, the amount of niobium required for the carbon stabilization can be decreased to about a half of that required in Type 347 stainless steel, so that the hot cracking during welding, which has long been regarded as the most critical problem of Type 347 stainless steel, can be relieved.

Further phosphorus contained as impurity in the steel is harmful for the weldability, but the steel according to the present invention has a lowered total phosphorus content not more than 0.013% and thus shows weldability equal to or better than that of Type 304 which is widely used at present.

A fourth feature of the present invention is that the steel of the present invention shows also excellent resistance to the transgranular stress corrosion cracking.

Figure 7:
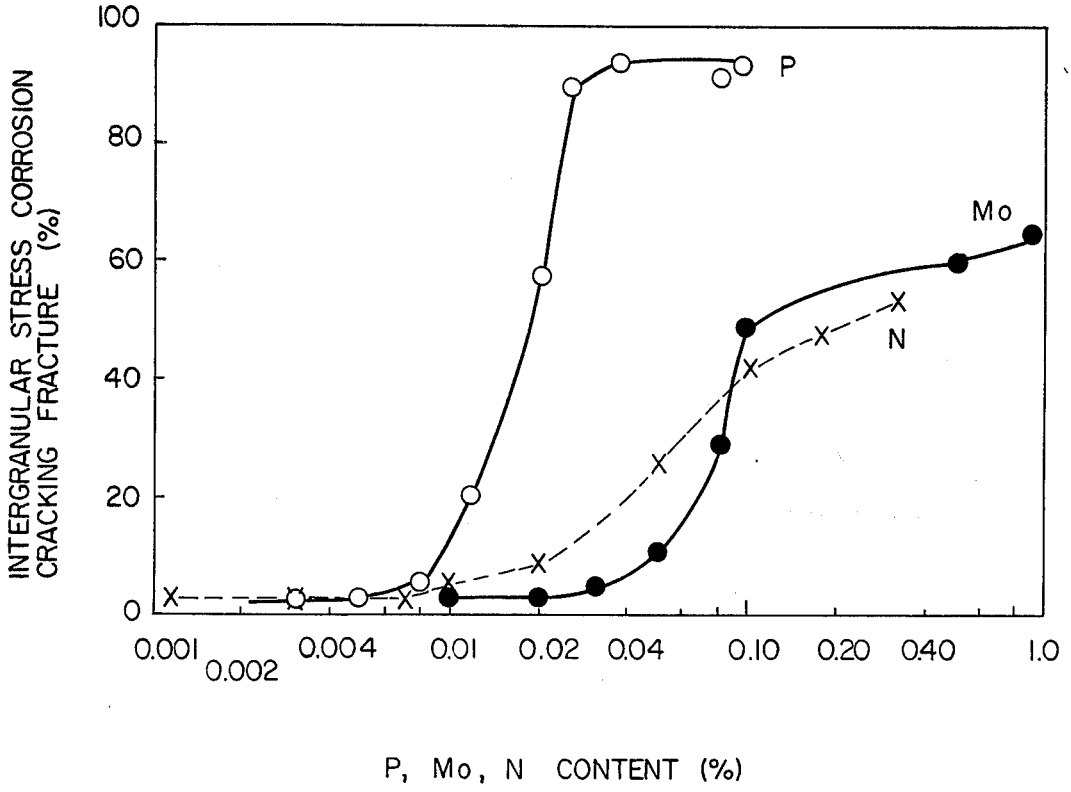

Effects of the phosphorus and molybdenum and nitrogen contents on the transgranular stress corrosion cracking susceptibility of a solid solution treated steel in a boiling magnesium chloride solution at 135° C. are shown in FIG. 7. In order to reduce the susceptibility in the solution, it is necessary to lower the phosphorus content to an amount not more than 0.008%. Molybdenum and nitrogen have also adverse effects, and the transgranular stress corrosion cracking resistance can be remarkably improved when the molybdenum content is lowered to an amount not more than 0.05%, preferably 0.03%, and the nitrogen content is lowered to an amount not more than 0.02%, preferably 0.01%. However, effects of the molybdenum and nitrogen content on the intergranular stress corrosion cracking has not been detected. Therefore, from the aspect of the transgranular stress corrosion cracking, the phosphorus content should be not more than 0.008%, the molybdenum content should be not more than 0.05%, preferably not more than 0.03%, and the nitrogen content should be not more than 0.02%, preferably not more than 0.01%.

Reasons for limitations of various elements defined in the present invention shall be explained hereinbelow:

Chromium is an alloy element essential for maintaining the corrosion resistance. Chromium contents less than 15% do not produce satisfactory corrosion resistance. However, the chromium content has large effects on the corrosion of the Cr-impoverished layer. In the present invention, the carbon content is restricted to an amount not more than 0.004%, so as to surpress the formation of the Cr-impoverished layer, and thus a chromium content of up to 22% is sufficient in the present invention.

Nickel is an alloy element indispensable together with chromium; and at least 9% of nickel is necessary for obtaining a stable austenite phase. Nickel doesn't have as large an effect on the intergranular stress corrosion cracking resistance, as it has on the transgranular stress corrosion cracking resistance, and nickel contents up to 18% are sufficient.

Carbon: One of the most important factors for the intergranular stress corrosion cracking in a high-temperature and high-pressure water is the formation of the chromium impoverished layer due to the intergranular precipitation of chromium carbide. In order to prevent the intergranular stress corrosion cracking due to the intergranular precipitation of chromium carbide, it is necessary to restrict the carbon content to an amount not more than 0.004% when a stabilizing element such as Nb is not added. When niobium is added in a range from 15 to 20 in the ratio of Nb/C, it is necessary to restrict the carbon content to an amount not more than 0.02%.

Silicon is added as a deoxidizing agent required for the steel refining. Although it has only a negligible effect on the intergranular stress corrosion cracking resistance, it has a remarkable effect on improvement of the transgranular stress corrosion cracking resistance. However, higher silicon contents lower the weldability so that its upper limit is set at 3.5%. Thus the silicon content may range from 0.3% preferably 0.5% to 3.5% in the present invention.

Manganese is required for deoxidization, and manganese contents not more than 2% as usually contained in austenitic stainless steels have no adverse effect on the intergranular stress corrosion cracking resistance. Therefore, in the present invention, the upper limit is set at 2%. Thus, the manganese content may range from 0.5% preferably 1.0% to 2% in the present invention.

Phosphorus remarkably deteriorates the transgranular stress corrosion cracking resistance, and segregates the grain boundaries during the sensitization treatment to promote the intergranular corrosion and sharply enhances the intergranular stress corrosion cracking susceptibility. Therefore, in the present invention, a lower phosphorus content is more desirable, and when no stabilizing element such as Nb is added, the phosphorus content is restricted to an amount not more than 0.005% so as to obtain the desired improvement of intergranular and transgranular stress corrosion cracking resistance. When niobium is added in an amount to maintain the ratio of Nb/C in a range from 15 to 20, phosphorus may be present up to 0.013%. Therefore the upper limit of the phosphorus content in the present invention is set at 0.013%.

Sulfur has, similar to phosphorus, adverse effects on the intergranular and transgranular stress corrosion cracking resistance, and also adverse effects on the pitting corrosion resistance and the over-all surface corrosion resistance, and the sulfur content should be maintained as low as possible, and with sulfur contents not more than 0.006%, the adverse effects become almost negligible.

Nitrogen has tendency to improve the intergranular stress corrosion cracking resistance, but remarkably deteriorates the transgranular stress corrosion cracking resistance. Therefore, the nitrogen content should be maintained as low as possible, and nitrogen contents not more than 0.02% are only negligibly harmful. Therefore, the upper limit is set at 0.02%.

Oxygen very often produces non-metallic inclusions and causes pitting corrosion. The non-metallic inclusions should be maintained as low as possible, because the intergranular stress corrosion crackings often occur initially at the site of the pitting corrosion. Therefore, the oxygen content is limited to an amount not more than 0.01%.

Molybdenum does not produce substantial effects on the intergranular stress corrosion cracking resistance, but has remarkably adverse effects on the transgranular stress corrosion cracking resistance. Molybdenum contents when restricted to an amount not more than 0.05% do not produce such adverse effects. Therefore, the upper limit is set at 0.05% in the present invention.

Niobium is an element necessary to prevent the intergranular stress corrosion cracking. The amount of niobium required is determined in corelation with the carbon content, but it is required in an amount not lower than 15 times the carbon content ($Nb/C \geqq 15$). Although a higher niobium content is more effective for the carbon stabilization, but increased niobium contents cause embrittlement of the heat effected zone of the weld, and particularly when the ratio of Nb/C is beyond 20, this adverse effect is more remarkable. Therefore, the desirable range of the niobium content is from 15 to 20 of the ratio of Nb/C.

DESCRIPTION OF PREFERRED EMBODIMENTS

The present invention will be more clearly understood from the following descriptions of examples.

The intergranular stress corrosion cracking susceptibilities of the steels according to the present invention and the comparison steels were determined in high-temperature and high-pressure water at 300° C. (pH: 6.7, chloride ion: not higher than 0.1 ppm, dissolved oxygen: 32–38 ppm) by a testing method employing constant extension rate stress corrosion cracking. Thus, the fractures of samples which showed a stress corrosion cracking rupture at a constant strain speed of $4.17 \times 10^{-6}$ sec.$^{-1}$ were observed by a scanning electron microscope, and the dimension of the fracture was divided by the whole dimension of the ruptured surface and multiplied by 100. The resultant values are shown as fracture appearance ratios of the intergranular stress corrosion cracking.

On the other hand, the transgranular stress corrosion cracking susceptibilities were determined in a boilding magnesium chloride solution at 135° C., and the fractures of samples which showed a stress corrosion cracking rupture at a constant strain speed at $1.67 \times 10^{-5}$ sec$^{-1}$ were observed and the transgranular stress corrosion cracking fracture appearance ratios were obtained in a similar way as above. The results are shown in Table 2 together with the steel compositions of the present invention and the comparison steel compositions.

The intergranular stress corrosion cracking in high-temperature and high-pressure water does not appear completely when the carbon content is lowered to an amount not more than 0.004% and impurities, particularly phosphorus, in the steel are lowered to an amount not more than 0.005%. Further, when the steel is stabilized by the niobium addition, the intergranular stress corrosion cracking does not appear at all even if the carbon content is up to 0.02% and the phosphorus content is up to 0.013%.

Further, the steels according to the present invention, in which the impurities such as phosphorus and molybdenum are restricted show a transgranular stress corrosion cracking resistance far better than that of the comparsion steels.

Table 2

| | | Cr | Ni | Si | Mn | C | P | S | O | N | Mo | Nb | Fe | Intergranular Stress Corrosion Cracking Fracture Ratio (%) | Transgranular Stress Corrosion Cracking Fracture Ratio (%) |
|---|---|---|---|---|---|---|---|---|---|---|---|---|---|---|---|
| Present Invention | 1 | 18.38 | 11.33 | 0.55 | 1.24 | 0.002 | 0.003 | 0.005 | 0.007 | 0.008 | <0.01 | <0.01 | Balance | 0 | 13.0 |
| " | 2 | 18.54 | 11.23 | 0.54 | 1.20 | 0.004 | 0.003 | 0.006 | 0.008 | 0.010 | <0.01 | <0.01 | " | 0 | 14.2 |
| " | 3 | 17.25 | 11.28 | 0.62 | 1.20 | 0.015 | 0.004 | 0.005 | 0.008 | 0.009 | <0.01 | 0.23 | " | 0 | 10.6 |
| " | 4 | 18.68 | 11.16 | 0.63 | 1.21 | 0.016 | 0.003 | 0.002 | 0.010 | 0.008 | <0.01 | 0.32 | " | 0 | 12.1 |
| " | 5 | 20.36 | 11.34 | 0.66 | 1.28 | 0.011 | 0.004 | 0.003 | 0.007 | 0.010 | <0.01 | 0.20 | " | 0 | 13.6 |
| " | 6 | 18.25 | 11.31 | 0.58 | 1.22 | 0.014 | 0.008 | 0.005 | 0.009 | 0.009 | <0.01 | 0.24 | " | 0 | 15.3 |
| " | 7 | 18.18 | 11.29 | 0.55 | 1.20 | 0.016 | 0.012 | 0.006 | 0.010 | 0.015 | <0.01 | 0.26 | " | 0 | 19.2 |
| " | 8 | 18.06 | 18.16 | 0.87 | 1.25 | 0.015 | 0.007 | 0.005 | 0.009 | 0.011 | <0.01 | 0.23 | " | 0 | 0.5 |
| " | 9 | 18.22 | 18.10 | 0.68 | 1.22 | 0.018 | 0.005 | 0.006 | 0.006 | 0.012 | 0.03 | 0.33 | " | 0 | 0.3 |
| " | 10 | 18.65 | 18.30 | 3.15 | 1.16 | 0.016 | 0.006 | 0.006 | 0.011 | 0.009 | 0.05 | 0.25 | " | 0 | 0.2 |
| Comparison | 1 | 18.50 | 11.50 | 0.58 | 1.17 | 0.002 | 0.024 | 0.012 | 0.008 | 0.012 | <0.01 | <0.01 | " | 24 | 88 |
| " | 2 | 18.38 | 11.44 | 0.57 | 1.21 | 0.004 | 0.026 | 0.010 | 0.009 | 0.011 | <0.01 | <0.01 | " | 29 | 72 |
| " | 3 | 18.58 | 11.17 | 0.59 | 1.25 | 0.009 | 0.004 | 0.003 | 0.009 | 0.005 | <0.07 | <0.01 | " | 90 | 19 |
| " | 4 | 18.22 | 11.08 | 0.58 | 1.19 | 0.061 | 0.027 | 0.009 | 0.005 | 0.006 | <0.01 | <0.01 | " | 96 | 80 |
| " | 5 | 18.30 | 9.65 | 0.72 | 1.32 | 0.060 | 0.026 | 0.004 | 0.012 | 0.018 | 0.12 | <0.01 | " | 89 | 100 |
| " | 6 | 17.96 | 9.24 | 0.68 | 1.36 | 0.040 | 0.024 | 0.005 | 0.014 | 0.021 | 0.09 | <0.01 | " | 95 | 98 |
| " | 7 | 18.56 | 9.03 | 0.64 | 1.25 | 0.016 | 0.031 | 0.003 | 0.010 | 0.017 | 0.11 | <0.01 | " | 96 | 95 |
| " | 8 | 18.22 | 11.02 | 0.62 | 1.30 | 0.010 | 0.025 | 0.007 | 0.012 | 0.008 | <0.01 | <0.01 | " | 94 | 93 |

What is claimed is:

1. An austenitic stainless steel having excellent intergranular and transgranular stress corrosion cracking resistance, consisting essentially of not more than 0.02% total carbon, not more than 0.004% of carbon in solid solution, 9 to 18% of nickel, 15 to 22 % of chromium, 0.5 to 2% of manganese, 0.3 to 3.5% of silicon, not more than 0.013% total phosphorus, not more than 0.005% phosphorus in solid solution, not more than 0.006% sulfur, not more than 0.02% nitrogen, not more than 0.01% oxygen, and niobium in an amount corresponding to $15 \leqq Nb/C \leqq 20$, with the balance being iron, said steel having Nb(P)C or Nb(PC) precipitated in grains, said steel having been subjected to a sensitization treatment.

2. An austenitic stainless steel according to claim 1, which further contains not more than 0.05% molybdenum.

* * * * *